US007258197B1

(12) United States Patent
Wicks

(10) Patent No.: US 7,258,197 B1
(45) Date of Patent: Aug. 21, 2007

(54) SCAFFOLD BRACKET

(76) Inventor: Frederic Wicks, 1705 Brazilian La., Winter Park, FL (US) 32792

( * ) Notice: Subject to any disclaimer, the term of this patent is extended or adjusted under 35 U.S.C. 154(b) by 293 days.

(21) Appl. No.: 11/127,066

(22) Filed: May 12, 2005

(51) Int. Cl.
*E04G 3/00* (2006.01)

(52) U.S. Cl. ..... 182/82; 248/246; 248/235

(58) Field of Classification Search ..... 182/82, 182/150, 113, 45, 112; 52/127.2; 248/243, 248/245, 246, 247, 210, 211, 244, 238, 235, 248/239

See application file for complete search history.

(56) References Cited

U.S. PATENT DOCUMENTS 1,449,700 A * 3/1923 Sampson ..... 248/235
2,308,142 A * 1/1943 Alloway ..... 182/82
2,465,143 A 3/1949 Wood
2,833,503 A * 5/1958 Harshbarger et al. ..... 248/235
2,940,716 A * 6/1960 Harlan ..... 182/82
2,957,670 A 10/1960 Wendl et al.
3,148,857 A * 9/1964 Hutchison ..... 182/82
3,595,510 A * 7/1971 Hutchinson ..... 182/82
3,698,680 A * 10/1972 Shoemaker ..... 182/82
3,776,498 A * 12/1973 Peters et al. ..... 182/82
3,804,199 A * 4/1974 Bondi ..... 182/82
3,970,277 A 7/1976 Riblet
4,122,916 A * 10/1978 Strobel ..... 182/82
4,368,800 A 1/1983 Campbell
4,372,425 A * 2/1983 Murphy ..... 182/82
4,452,336 A * 6/1984 Sickler ..... 182/82
4,909,350 A * 3/1990 Jacobs ..... 182/82
4,971,169 A * 11/1990 Fruth ..... 182/150
5,156,235 A * 10/1992 Preston ..... 182/82
5,259,477 A 11/1993 Fears et al.
5,307,899 A * 5/1994 Lubinski ..... 182/82
5,388,663 A * 2/1995 Phillippe et al. ..... 182/82
5,535,974 A 7/1996 Savitski
5,771,991 A * 6/1998 Fresco ..... 182/82
5,799,750 A 9/1998 Garcia
5,865,410 A * 2/1999 Horen ..... 182/82
5,884,725 A 3/1999 Reyland
6,003,630 A * 12/1999 Whalen ..... 182/82
6,026,932 A 2/2000 Comp
6,131,698 A 10/2000 Reyland
6,273,381 B1 * 8/2001 Riblet ..... 248/235
6,394,227 B1 * 5/2002 Frestad ..... 182/82
6,422,339 B1 * 7/2002 Wisler ..... 182/82
6,550,188 B2 * 4/2003 Bolinger et al. ..... 182/82
6,955,242 B2 * 10/2005 Markovich ..... 182/82
6,983,824 B1 * 1/2006 Dandurand ..... 182/82

* cited by examiner

*Primary Examiner*—Hugh B. Thompson, II
(74) *Attorney, Agent, or Firm*—William M. Hobby, III

(57) ABSTRACT

A scaffold bracket apparatus removably attaches to a screen enclosure framework. A pair of scaffold brackets are attached to an aluminum frame for a screen enclosure for supporting a plurality of planks thereacross to support a person thereon. The scaffold bracket has a plank supporting arm having a pair of brace members which grip each side of a generally perpendicular frame member for attaching the plank supporting arm to the generally vertically extending frame member. A locking spline is removably attached to one of the brace members for engaging a groove in the vertically extending frame member to lock the scaffold bracket against slipping sideways.

9 Claims, 3 Drawing Sheets

SCAFFOLD BRACKET

BACKGROUND OF THE INVENTION

The present invention relates generally to a scaffold bracket used to form scaffolding for construction and repair of aluminum frame screening structures and especially to a scaffold bracket which quickly attaches directly to the screen enclosure frame structure during construction of a screen enclosure for a swimming pool or the like.

It is desirable to have scaffolding for construction workers to attach the screen of an aluminum frame while installing screen onto an aluminum frame structure. The vertical framing members or posts of an aluminum frame structure typically have a pair of parallel grooves adjacent each vertical edge which are designed for attaching the screen to the frame member. The screen can be attached by using ladders or scaffolding placed adjacent to the aluminum frame so that a worker can reach the higher levels of the framework for attaching the screen.

The present invention is directed toward a scaffolding system that attaches directly to the aluminum frame so that the person installing the screen to the frame can easily reach any portion of a frame structure for attaching the screen without having to use a ladder which often has to be placed within heavy shrubbery or on a sloped surface.

In the past, various types of scaffolding which attaches to a framing structure has been suggested. In the Savitski U.S. Pat. No. 5,535,974, a scaffold bracket is removably attached to the stud of a building under construction. The scaffold bracket has first and second gripping members attached to a support arm for engaging both sides of a stud so that a downward force on the support arm, supporting boards, causes the first and second grippers to exert a gripping force on the stud. The first and second gripping members each have a plurality of nails protruding therefrom which are forced into the stud for holding the bracket in place. In the Campbell U.S. Pat. No. 4,368,800, a scaffold apparatus uses a matched pair of plank brackets with a releasable clamping mechanism adapted to clamp the brackets to a pair of timber posts.

In the G. D. Wendl et al. U.S. Pat. No. 2,957,670, a scaffold is provided which uses two-by-four vertical support members in the scaffolding along with upper hoop brackets or hangers. The Riblet U.S. Pat. No. 3,970,277 is for a self-locking scaffold bracket employing a load activated lock which locks onto an upright post. The scaffold is raised by a hoisting device to walk it up the post. The Comp U.S. Pat. No. 6,026,932 is a flush mounting scaffolding brace which is nailed to the studs of a structure for supporting the scaffolding planks. The Fears et al. U.S. Pat. No. 5,259,477 shows a collapsible scaffolding bracket while the Reyland U.S. Pat. No. 6,131,968 is for a scaffolding assembly.

Other scaffolding patents can be seen in the T. L. Wood U.S. Pat. No. 2,465,143 for scaffolding and in the Garcia U.S. Pat. No. 5,799,750 for a portable scaffold and in the Reyland U.S. Pat. No. 5,884,725 for a scaffolding assembly.

The present invention in contrast to these prior scaffolding brackets and assemblies provides for a scaffold bracket for removably attaching to a screen enclosure framework such as used to provide a screen enclosure to a swimming pool or the like and is advantageously designed to avoid damage to the aluminum framing while allowing a screen to be attached while the scaffolding bracket is supported on the frame post.

SUMMARY OF THE INVENTION

A scaffold bracket apparatus removably attaches to a screen enclosure framework. A pair of scaffold brackets are attached to an aluminum frame for supporting a plurality of planks for supporting a person thereon. The scaffold bracket has a plank supporting arm having a first brace member attached generally perpendicular to the plank supporting arm for bracing against one side of a generally vertically extending frame member having a pair of vertically extending grooves therein. A locking spline is removably attached to this first brace member for engaging one of the grooves in the vertically extending frame member when the first gripping member is braced thereagainst. A coupling arm attaches to the plank supporting arm and has a second brace member attached thereto for positioning against the other side of the generally vertically extending frame member. The scaffolding bracket first and second, brace members can be positioned on opposite sides of the generally vertically extending frame member to lock the scaffold bracket to the generally vertically extending frame member when a downward force is applied to the plank supporting arm. The first and second brace members each have an elongated surface to spread the force that is being applied against the aluminum generally vertically extending frame member and each brace has a rubber gripping surface thereon. A flexible safety coupling, such as a bungee cord, is attached at one end to the coupling arm and the other end can be removably attached to the generally vertically extending frame member to maintain a constant bias, pulling the coupling arm and second gripping member towards the vertically extending frame member. The locking spline that engages the vertically extending grooves on the vertically extending frame member is removably attached and can be attached to either side of the first gripping member for locking into either of the parallel grooves on the vertically extending frame member.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
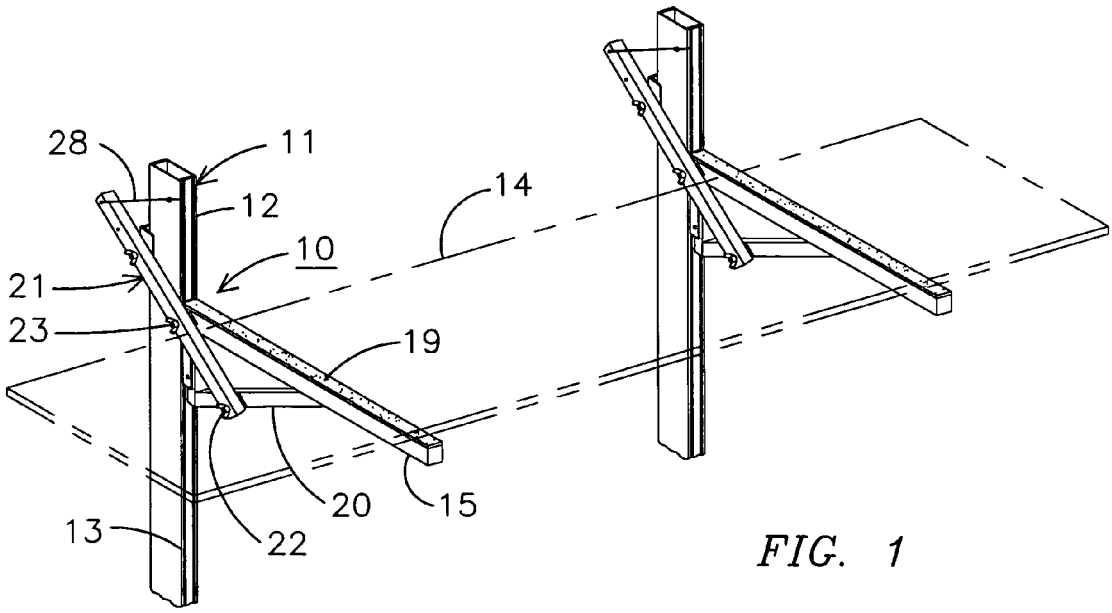
FIG. 1 is a perspective view of a pair of scaffolding brackets in accordance with the present invention attached to aluminum framing posts.
Figure 2:
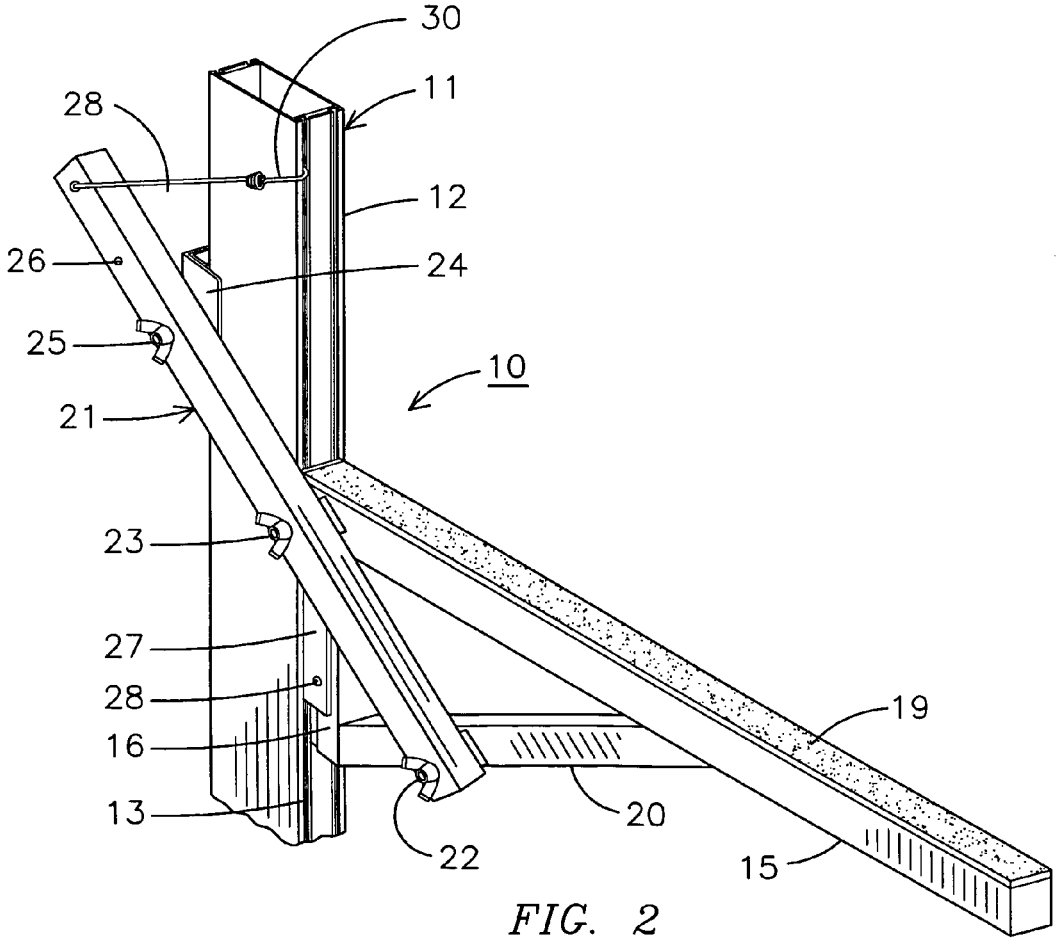
FIG. 2 is a perspective view of the scaffolding bracket of FIG. 1 attached to the framing post.
Figure 3:
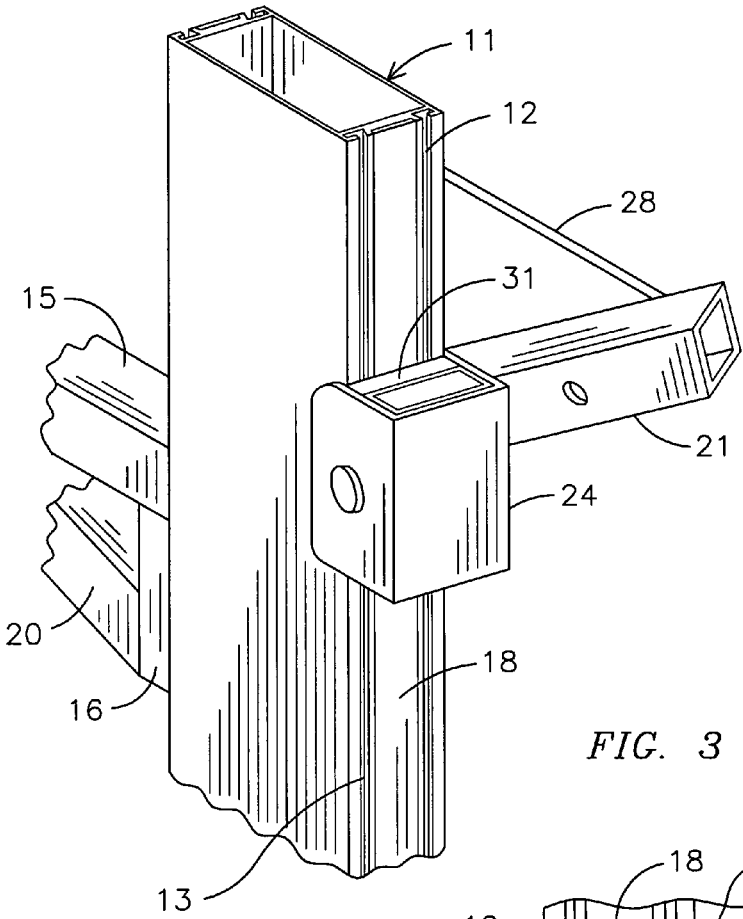
FIG. 3 is a partial perspective view of the rear of the scaffold bracket attached to the post.
Figure 4:
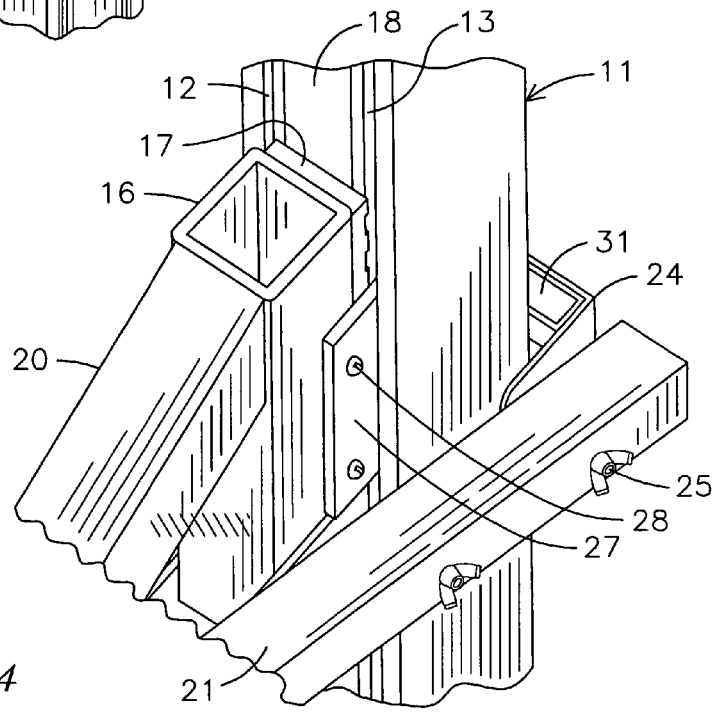
FIG. 4 is an upside down perspective of the scaffold bracket connection of FIGS. 1-3.
Figure 5:
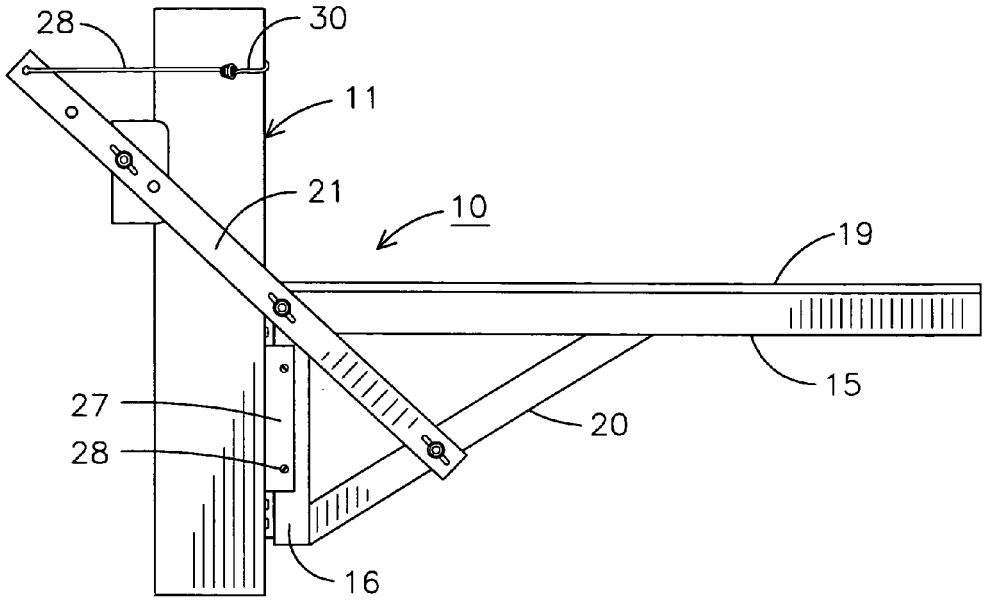
FIG. 5 is a side elevation of the scaffold bracket of FIGS. 1-4 attached to a framing post.
Figure 6:
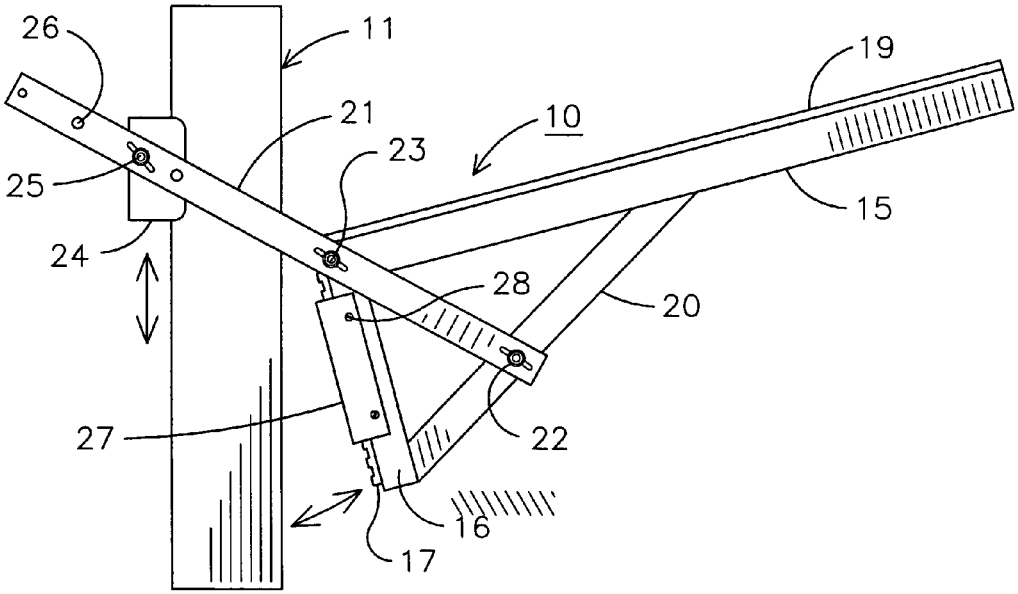
FIG. 6 is a side elevation of the scaffold bracket being repositioned on a framing post.

Referring to the drawings of FIGS. 1-6, a scaffold bracket 10 is illustrated attached to a generally vertically extending framing member 11. The framing member 11 is an aluminum channel having a pair of vertically extending grooves 12 and 13 on one edge thereof. The aluminum framing member 11 is the type of screen enclosure, such as a screened pool enclosure, in which the grooves 12 and 13 are used to attach the screen to the post framing member 11. A pair of scaffold brackets 10 are attached to a pair of framing posts for supporting planks or boards 14, as shown in the phantom view in FIG. 1. Each scaffold bracket 10 has a plank supporting arm 15 having a non-slip or rubber surface 19 attached to a front brace member 16. The brace member 16 has a rubber gripping surface 17 thereon for gripping the edge 18 of the generally vertically extending frame member 11. The plank supporting arm 15 has an arm 20 connected between the plank supporting arm 15 and the brace member 16. A coupling arm 21 is connected with a bolt and wing nut 22 to the arm 20 and with a bolt and wing nut 23 to the plank supporting arm 15. The coupling arm 21 attaches to a second or rear brace member 24 with a bolt and wing nut 25. The second brace member 24 is connected with the bolt and wing nut 25 in a manner that the coupling arm 21 can rotate thereon, as shown in FIG. 6. The coupling arm 21 has a plurality of additional apertures 26 therein.

The front or first brace member 16 has a locking spline 27 attached to the side thereof with a pair of threaded fasteners 28 which positions the spline in a position to fit into one of the grooves 12 or 13. The locking spline 27 may be placed on either side of the brace member 16 for locking in either the groove 12 or the groove 13, depending on which side of the framing member 11 the scaffold bracket is to be attached. The locking spline 27 holds the scaffold bracket 10 in position from moving to either side when locked in place on a framing member 11. A flexible safety coupling 28, which may be a bungee cord or a spring, is attached at one end to the coupling arm 21 and has a hook 30 on the other end thereof. The flexible safety coupling can be hooked with the hook 30 into a groove 12 or 13 when the scaffold bracket 10 is attached to a generally vertical post 11.

In operation, the scaffold bracket 10 can be slipped over one side of the generally vertical framing member 11, as shown in FIG. 6, having the second or rear brace member 24 placed on one side of the post 11. Rotating the plank supporting arm 15 to the front pushes the first brace member 16 against the edge 18 of the frame member 11, as more clearly illustrated in FIGS. 5 and 6. This brings the gripping surface 17 into contact with the surface 18 of the framing member 11. Downward pressure placed on the plank supporting arm 15 locks the scaffold brace in place by pulling the brace member 24 onto the framing member 11.

The second brace member 24 also has a rubber gripping surface 31 thereon for gripping the opposite side of the vertical frame member 11. Once a pair of scaffold brackets 10 are locked to a pair of vertical frame members 11 with the locking splines 27 positioned in the grooves 11 or 12, the scaffold bracket will support the planks 14 thereacross to support a workman. The flexible safety coupling 28 can then be extended to attach the hook 30 to the frame member 11 by sliding into one of the grooves 11 or 12. This safety coupling pulls or biases the coupling arm 21 to pull the brace member 24 against the frame member 11 to assure the scaffold bracket is prevented from loosening by arm 15 being lifted slightly to allow the brace to slide.

The scaffold bracket, in accordance with the present invention, advantageously allows a worker to install or replace screen on an aluminum frame. The scaffold bracket uses the elongated brace members 16 and 24 to spread the forces on the aluminum frame 11 to thereby prevent the denting or collapsing of the frame member 11. In addition, the use of a locking spline 27 in one of the grooves 12 or 13 advantageously prevents the scaffolding member from shifting or sliding to one side and further locks the scaffold bracket in place. The locking spline advantageously can be placed on either side of the brace member 16 so that the scaffold bracket can be placed on either side of a framing member 11 to allow one or the other grooves 12 or 13 to be clear for attaching the screening in the groove while the scaffold bracket is attached to the framing member 11.

The present invention however is not to be considered limited to the form illustrated which is to be considered illustrative rather than restrictive.

I claim:

1. A scaffold bracket for removably attaching to a screen enclosure framework comprising:

a plank supporting arm;

a first brace member attached generally perpendicular to said plank supporting arm for bracing against one side of a generally vertically extending frame member having at least one vertically extending groove therein;

a locking spline attached to said first brace member for engaging a groove in said generally vertically extending frame member when said first brace member is braced thereagainst;

a coupling arm attached to said plank supporting arm; and a second brace member attached to said coupling arm and positioned to brace against the other side of said generally vertically extending frame member;

whereby said scaffold bracket first and second brace members can be positioned on opposite sides of said generally vertically extending frame member to lock said scaffold bracket to said generally vertically extending frame member when a downward force is applied to said plank supporting arm.

2. The scaffold bracket in accordance with claim 1 having a flexible safety coupling attached to said coupling arm and being removably attachable to said generally vertically extending frame member.

3. The scaffold bracket in accordance with claim 2 in which said flexible safety coupling is a bungee cord.

4. The scaffold bracket in accordance with claim 1 in which said first brace member has an elongated gripping surface for pressing against said one side of said generally vertically extending frame member.

5. The scaffold bracket in accordance with claim 4 in which said first brace member elongated gripping surface has a rubber gripping surface.

6. The scaffold bracket in accordance with claim 5 in which said second brace member has an elongated gripping surface for pressing against said other side of said generally vertically extending frame member.

7. The scaffold bracket in accordance with claim 6 in which said second brace member elongated gripping surface has a rubber gripping surface.

8. The scaffold bracket in accordance with claim 1 in which said locking spline is removable attached to said first brace member.

9. The scaffold bracket in accordance with claim 8 in which said locking spline is removable attached to either side of said first brace member to thereby allow said scaffold bracket to be attached to either side of a generally vertical extending frame member having a pair of vertically extending grooves therein whereby a screen can be attached to said generally vertically extending frame member while said scaffolding bracket is attached thereto.

* * * * *